US006764069B2

(12) United States Patent
Reist

(10) Patent No.: US 6,764,069 B2
(45) Date of Patent: Jul. 20, 2004

(54) APPARATUS FOR PROCESSING FLAT OBJECTS, ESPECIALLY PRINTED PRODUCTS

(75) Inventor: Walter Reist, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/427,133

(22) Filed: May 1, 2003

(65) Prior Publication Data

US 2003/0183999 A1 Oct. 2, 2003

Related U.S. Application Data

(63) Continuation of application No. PCT/CH01/00643, filed on Oct. 30, 2001.

(30) Foreign Application Priority Data

Nov. 2, 2000 (CH) ..... 2139/00

(51) Int. Cl.[7] ..... B65H 7/20

(52) U.S. Cl. ..... 270/52.29; 270/52.26; 270/52.14; 198/459.8; 198/419.1; 198/343.2

(58) Field of Search ..... 198/465.1, 343.1, 198/343.2, 419.1, 459.8, 460.3, 867.11, 867.14, 690.1; 270/52.14, 52.16, 52.18, 52.19, 52.26, 52.29

(56) References Cited

U.S. PATENT DOCUMENTS

| | | | | |
|---|---|---|---|---|
| 5,094,438 A | | 3/1992 | Reist et al. | |
| 5,375,824 A | * | 12/1994 | Anker et al. | 270/52.29 |
| 5,499,803 A | * | 3/1996 | Farr | 270/52.14 |
| 5,503,264 A | * | 4/1996 | Eberle | 198/867.05 |
| 5,667,211 A | * | 9/1997 | Reist | 270/52.16 |
| 5,713,565 A | | 2/1998 | Meier | |
| 5,730,436 A | * | 3/1998 | Viebach et al. | 270/52.16 |
| 5,758,871 A | | 6/1998 | Schlough | |
| 5,765,823 A | | 6/1998 | Meier et al. | |
| 5,777,443 A | * | 7/1998 | Chang | 318/35 |
| 5,810,345 A | | 9/1998 | Lehmann et al. | |
| 5,874,812 A | * | 2/1999 | Chang | 318/35 |
| 5,901,949 A | | 5/1999 | Muranaka et al. | |
| 6,311,968 B1 | * | 11/2001 | Linder et al. | 270/52.25 |
| 6,612,559 B2 | * | 9/2003 | Boss | 270/52.18 |

FOREIGN PATENT DOCUMENTS

| | | |
|---|---|---|
| DE | 196 38 448 | 5/1997 |
| DE | 197 36 822 | 3/1998 |
| EP | 0 354 343 | 2/1990 |
| EP | 0 680 916 | 11/1995 |
| EP | 0 771 754 | 5/1997 |
| EP | 0 828 190 | 3/1998 |

OTHER PUBLICATIONS

Copy of International Search Report for PCT/CH01/00643 completed Jan. 18, 2002.

* cited by examiner

*Primary Examiner*—Patrick Mackey
(74) *Attorney, Agent, or Firm*—Alston & Bird LLP

(57) ABSTRACT

An apparatus for processing flat objects, such as sheet-like printed products. The apparatus has a rail system which defines a closed path of travel, and a plurality of conveyor elements are supported by the rail system for free and independent movement along the path of travel. The conveyor elements in turn mount product carrier elements. A plurality of stations, including a product feed station, a product processing station, and a product output station, are disposed along the path of travel, and the stations each include a dedicated drive arrangement for the conveyor elements and thus the product carrier elements along the path of travel at a spacing and speed required by the associated station.

15 Claims, 3 Drawing Sheets

APPARATUS FOR PROCESSING FLAT OBJECTS, ESPECIALLY PRINTED PRODUCTS

CROSS-REFERENCE TO RELATED APPLICATION

This is a continuation of international application Ser. No. PCT/CH01/00643, filed Oct. 30, 2001, and designating the U.S. The subject matter of the referenced application is incorporated herein by reference.

BACKGROUND OF THE INVENTION

The present invention relates to a an apparatus for processing flat objects, especially printed products, of the general type disclosed in EP-A-0 771 754 and the corresponding U.S. Pat. No. 5,765,823.

In such prior apparatus, a saddle-like rest as well as a rest wall and carrier elements having a base are arranged at a distance one behind the other in the manner of a cantilever on an endless flexible drive element which is driven continuously. The flexible drive element is configured as a conveyor chain guided in a channel over rolls. A first feed station is intended either for depositing folded printed products opened and in straddling form onto the saddle-like rest of the carrier elements moving past it for feeding printed products to the carrier elements in such a way that they become into contact with the base and rest wall. Processing stations configured as further feed stations are arranged downstream of the first feed station as seen in the conveying direction of the flexible drive element forming the conveying mechanism, with the same intended purpose as first feed station. At an output station downstream of processing stations, the combined printing products are removed from the carrier elements and output for further processing.

In the case of this known device all the stations must operate synchronously with the continuously driven endless flexible drive element.

It is an object of the present invention to further develop the known device such that it can be adapted or is adapted to have more flexibly, with respect to the boundary conditions required by the individual stations.

SUMMARY OF THE INVENTION

The above and other objects and advantages of the invention are achieved by the provision of an apparatus which comprises a rail system which extends along a preferably closed path of travel.

The conveying mechanism is formed by a large number of conveyor elements which can be moved individually along the rail system, each of the carrier elements preferably being arranged on one of the conveyor elements in the manner of a cantilever. The conveyor elements and thus carrier elements are decoupled from each other and can be moved individually in the rail system. If the conveyor elements abut each other they can of course be moved forward by the transmission of impact forces, but they do not exert any tensile or pulling forces on each other.

Each of the stations, e.g. the feed station, the processing station or stations, and the output station, has a dedicated drive arrangement for the conveyor elements, which convey the conveyor elements and carrier elements at the spacing and speed required by the station in question. Each station can be operated optimally by virtue of the conveyor elements being decoupled and by virtue of the dedicated drive arrangements, the stations being independent of one another.

Sections of the rail system serving as a buffer storage section allow buffer storage of carrier elements and of the objects transported by means of the latter. In this way it is also possible to considerably compensate for stations being interrupted.

To permit a modular construction of the apparatus, a section of the rail system is permanently joined to each of the stations, with other sections serving as buffer storage or connecting sections, so that it is possible to combine the sections as desired to form a closed rail system.

Further particularly preferred embodiments of the apparatus according to the invention are specified in the following more detailed description of the invention.

BRIEF DESCRIPTION OF THE DRAWINGS

The invention will be explained in more detail using exemplary embodiments depicted in the drawings. In the drawings, purely schematically.

DETAILED DESCRIPTION OF THE PREFERRED EMBODIMENTS

Figure 1:
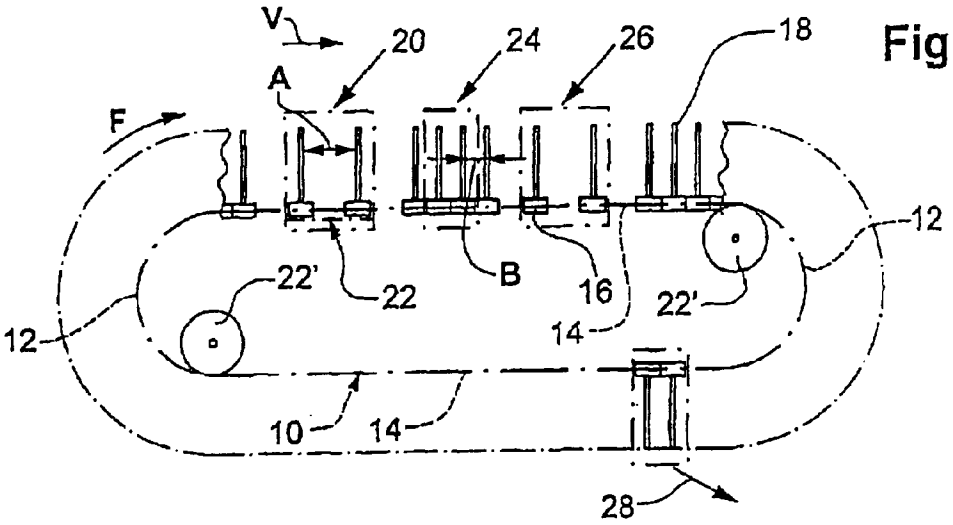
FIG. 1 shows a plan view of a device embodied as circulating system.

The apparatus shown in FIG. 1 has a rail system 10 which extends in a horizontal plane and is intrinsically closed. Two semicircular rail sections 12 are connected to each other by means of rectilinear rail sections 14 to form a circulating system. A large number of individual conveyor elements 16 are arranged one behind the other in the rail system 10 and are guided so that they can move freely and independently along the rail system. The number of conveyor elements 16 is selected such that they do not form an intrinsically closed impact chain by abutting against each other; in other words there are gaps between individual successive conveyor elements.

A carrier element 18 is fastened to each of the conveyor elements in the manner of a cantilever, the carrier element projecting outward from the conveyor element 16 in the radial direction with regard to the rail system 10.

A first feed station 20 is indicated by a dash-dotted rectangle. It is assigned a dedicated drive arrangement 22 which is intended for moving conveyor elements 16 and hence the carrier elements 18 at a specific spacing A and at a specific speed V, through the feed station 20 in the conveying direction F so that the feed station can feed a flat object, for example a printed product, to each carrier element 18.

A processing station 24 likewise with a dedicated drive arrangement is arranged at a distance from and downstream of the feed station 20 as seen in the conveying direction F. This processing station is intended for moving the conveyor elements 16 in the buffer stored state, i.e. resting on each other, and thus the relevant carrier elements 18 through the processing station 24 at a minimum spacing B and a speed specified by said processing station. In the processing station, a further object can be attached, for example adhesively bonded, to the objects fed in the feed station 20, or any other desired processing operation on the relevant objects can take place.

A further processing station which is configured as a further feed station 26 is arranged downstream of and at a distance from the processing station 24. Its construction and functioning correspond to those of the feed station 20.

A drive arrangement 22' is assigned to a further section of the rail system, the object of which drive arrangement is to drive the incoming conveyor elements 16 in the conveying direction F so that they reach an output station 28. The output station in turn has a dedicated drive arrangement which is intended for moving the conveyor elements 16 through the output station 28 in the buffer-stored state, i.e. spacing B. The objects fed to the carrier elements 18 upstream and processed in the processing station 24 are removed from the carrier elements 18 in the output station 28 and fed to a further processing operation.

A drive arrangement 22' is assigned to a further rail section downstream of the output station 28 in order to feed the carrier elements 18 to the feed station 20 again.

The apparatus can be adapted to the individual requirements as all the stations 44 mentioned and the rail system 10 are of modular construction. It is thus conceivable, for example, to arrange stations 44 in turn between the output station 28 and the feed station 20, as seen in the conveying direction F, it being possible for said stations to form a dedicated processing path for objects or said stations forming a single processing path together with the stations 44 shown further above.

Figure 2:
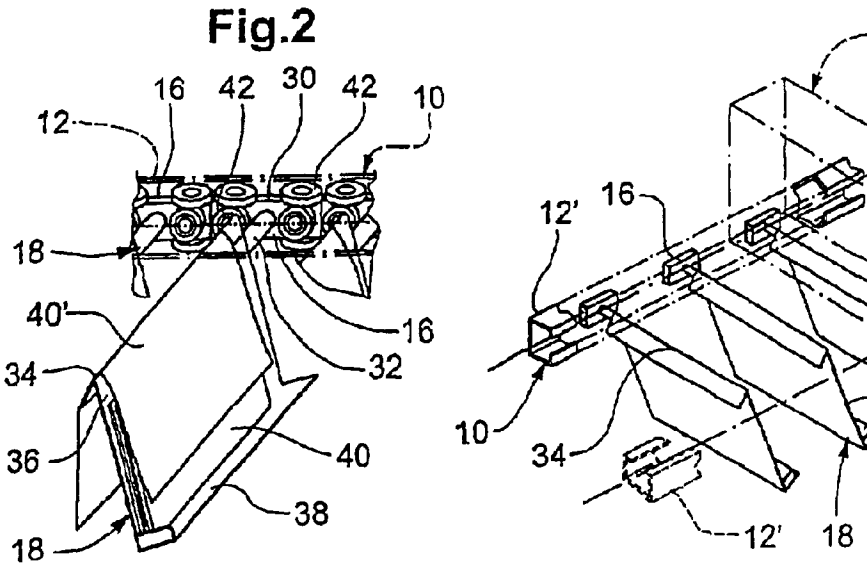
FIG. 2 shows a detail of the device according to FIG. 1 with individual conveyor elements and carrier elements arranged in the manner of a cantilever on the latter.

FIG. 2 shows a section of the apparatus represented in FIG. 1 with three conveyor elements 16 abutting the end of each other in the buffer stored state. Each of the conveyor elements 16 has a conveyor element body 30 on which a horizontal carrier shaft 32 is fastened in the manner of a cantilever. The carrier shaft carries a carrier element 18 formed, for example, from metal sheet at a distance from the conveyor element body 30, with the carrier element firstly forming a saddle-like rest 34 and secondly having a flat rest element 36 and an adjoining base 38. A multipart flat object 40, for example a first printed product, lies on the base 38 and on the rest wall 36, the object having been fed to the carrier element 18 by means of the feed station 20 (FIG. 1), for example. A further folded object 40' sits in straddling form on the rest 34 and covers the object 40. The object 40' has been opened for example by means of the further feed station 26 (FIG. 1), and deposited onto the rest 34.

Guide wheels 42 are mounted such that they can rotate freely on each conveyor element body 30 and mount the conveyor element 16, in the manner of a carriage and such that it can move freely, on the rail which is C-shaped in cross section. The ends of the conveyor element bodies 30 are configured as abutting surfaces in order to rest on the facing end of the conveyor element body 30 of the adjacent conveyor element 16 in the buffer stored state.

Figure 3:
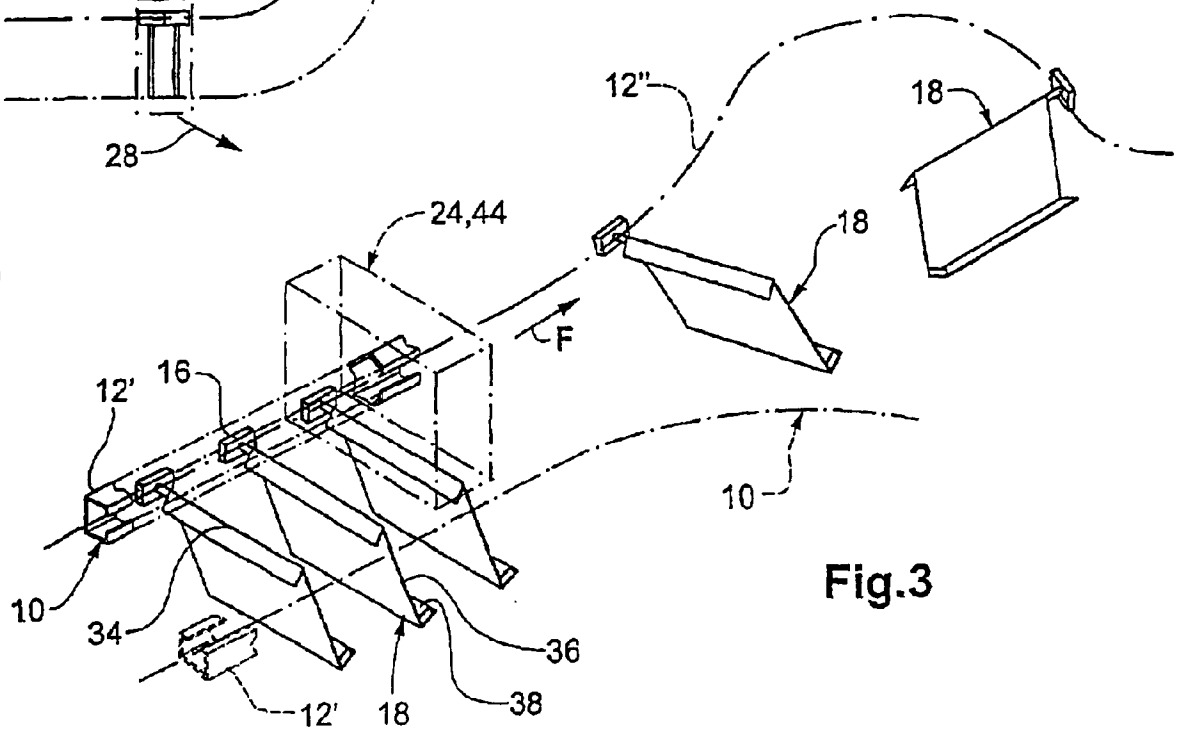
FIG. 3 shows a further possible embodiment of a section of the device with a station and a three-dimensionally curved section of the rail system.

FIG. 3 schematically shows a processing station 24 with an associated rail section 12'. The drive arrangement assigned to this processing station 24 is not shown. It is intended for moving the conveyor elements 16, these and the carrier elements 18 are configured identically to those shown in FIG. 2 and described further above, at a predetermined spacing and at a predetermined speed through the processing station 24. This movement can of course be carried out continuously or in start/stop operation.

A further rail section 12" serving as a connecting path is connected downstream of the rail section 12' and is three dimensionally curved with a narrow radii. It is also an object of the processing station 24 to release the conveyor elements 16 with such a spacing that they can move through the pronounced curvature of the rail section 12" without hindering each other. This rail section 12" may, for example, be sloped so that no further drive arrangement is necessary.

A further possibility for arranging the rail guidance means with regard to the conveyor and carrier elements 16, 18 is indicated by dash-dotted lines. The conveyor elements 16 are correspondingly located adjacent to the base 38, for example approximately centrally as seen in its longitudinal direction.

Figure 4:
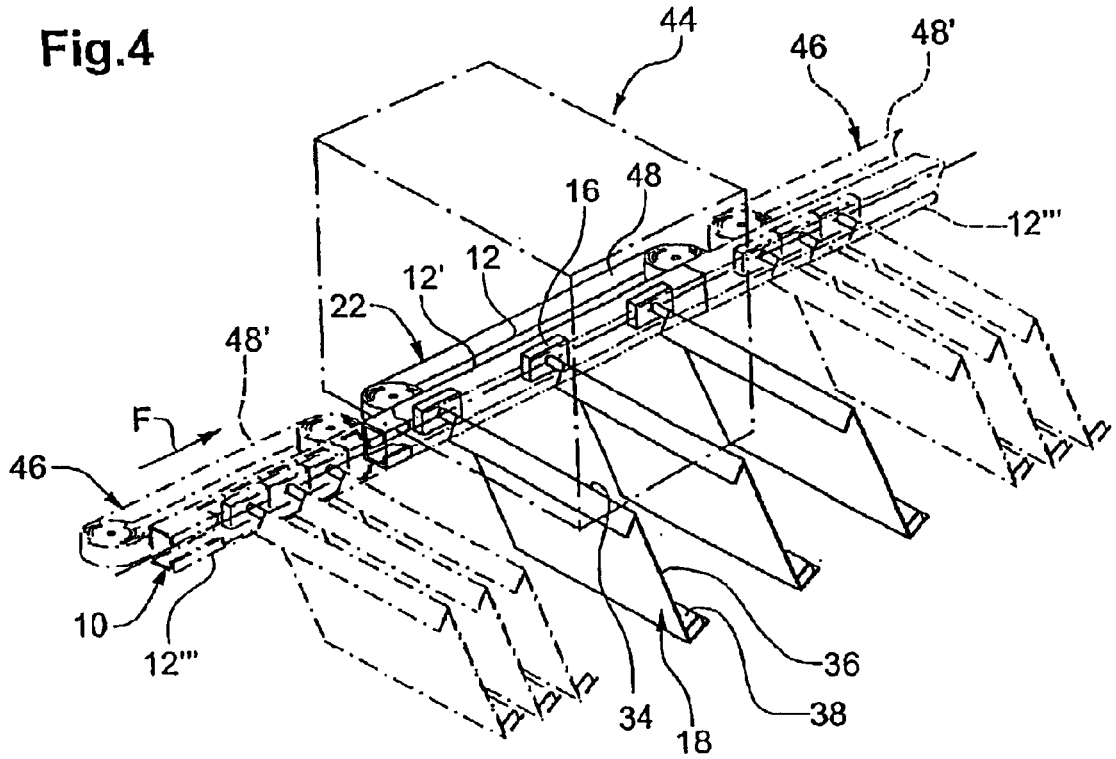
FIG. 4 shows a station together with a section of the rail system assigned to it and the drive arrangement assigned to it with further upstream and downstream sections of the rail system.

FIG. 4 shows a station 44, configured as a module or modular insert, which may be a feed station 20, a processing station 24 or an output station 28 and has a permanently joined rail section 12' and a dedicated drive arrangement 22. Rail sections of adjacent stations adjoin both ends of the rail section 12', the two adjacent stations in the example shown being configured as buffer storage stations 46 each having a dedicated rail section 12'" and a dedicated drive arrangement 22.

The drive arrangement 22 of the station 44 has a belt 48 which is driven in circulation and moves the conveyor elements 16 through the station 44 with a form fitting or force transmitting connection at a predetermined mutual spacing and at a stipulated speed. A feeder wheel or a controlled release device, for example, may be provided on the entry side of the drive arrangement 22 in order to feed or release in each case a conveyor element 16 to the belt 48 at the desired times for driving.

The buffer storage stations 46 have a further belt 48' which is driven in circulation in the conveying direction F and drives the conveyor elements 16 in the conveying direction F, for example by means of a frictional or magnetic connection, until said conveyor elements rest on one another in the buffer stored state.

Figure 5:
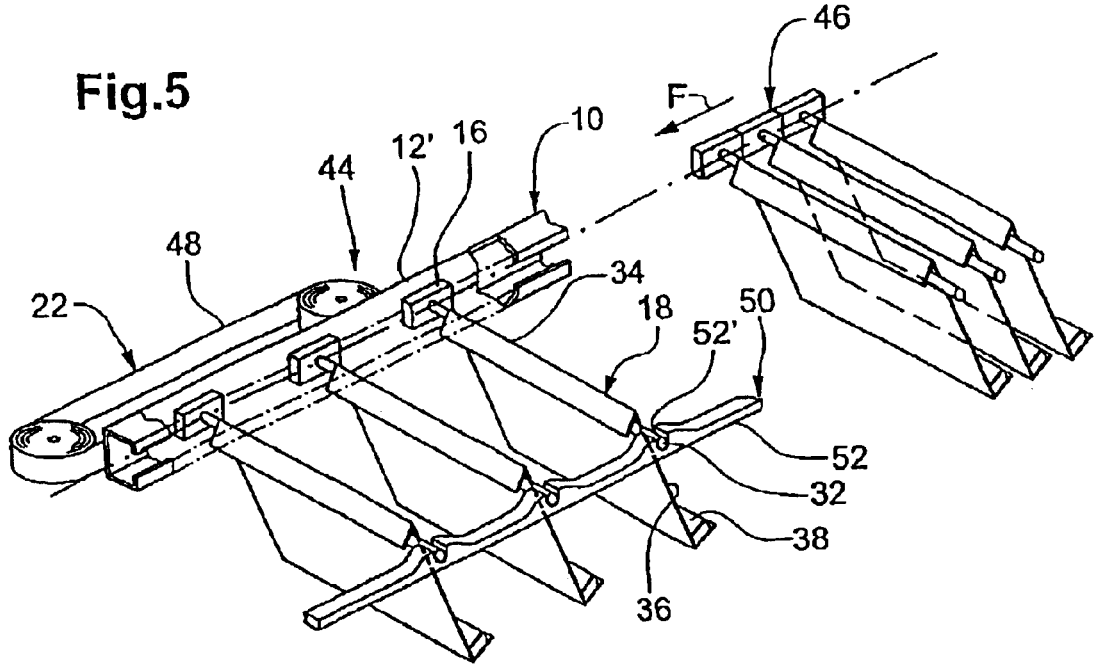
FIG. 5 shows a section of the rail system with a supporting means, acting, for example, as an auxiliary drive, for the carrier elements.

In the embodiment shown in FIG. 5, the carrier shafts 32 of the carrier elements 18, on the side facing away from the conveyor elements 16, project beyond the rest 34 and the rest element 36. The rail section 12' shown is likewise assigned a drive arrangement 22 which drive the conveyor elements 16 in the conveying direction F in a manner which permits slip to occur. The station 44 shown in FIG. 5 has an auxiliary drive arrangement 50 which also serves as a supporting device and has a pulling element 52 which is driven in the conveying direction F, is intrinsically closed and has groove-like recesses 52' at predetermined spacings for accommodating the free end regions of the carrier shafts 32. The spacing and the conveying speed of the carrier elements 18 is stipulated in this case by the auxiliary drive arrangement 50.

Upstream of the station 44, a rail section 12''' serving as a buffer storage path is provided, for example with a slope, from which rail section in each case one conveyor element 16 is sequentially taken by means of the auxiliary drive arrangement 50 and moved through the station 44 at the desired spacing from the preceding carrier element 18. The carrier elements 16 are supported at both ends in the station 44 shown in FIG. 5. This can be advantageous in particular when processing operations are to be performed on the objects 40, 40', for example if objects deposited on top of one another are to be connected to one another by means of staples.

Figure 6:
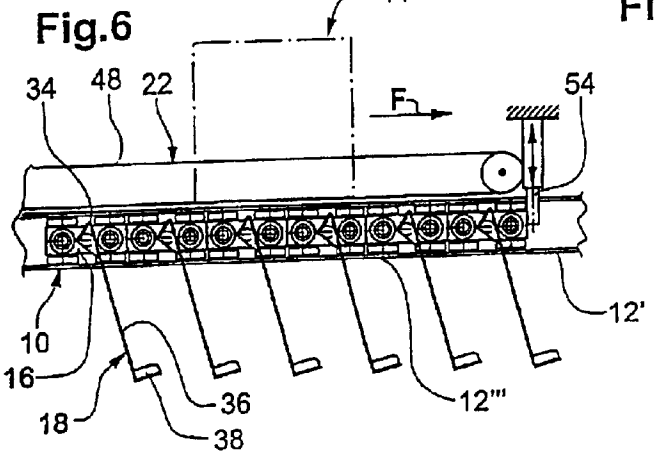
FIG. 6 shows a section of the rail system with a queuing element connected and a station arranged in the queuing section.

FIG. 6 shows part of a station 44 which has a queuing element 54 connected at its downstream end. Adjoining the queuing element 54 in the upstream direction, the station 44 has a dedicated drive arrangement 22 with a belt 48 which is driven in circulation in the conveying direction F. Said belt is intended for driving conveyor elements 16 which come into its active region until they come into contact with the respective preceding conveyor element 16. The force transmitting coupling between the belt 48 and the conveyor elements 16 can be formed, for example, by a frictional connection or magnetic connection. In this case the station 44 requires the carrier elements 18 to be stationary for it to process objects 40, 40' which are either to be fed to the conveyor elements 16 or have already been fed to them earlier by means of a feed station 20. At the cycle rate stipulated by the station 44, the queuing element 54 releases in each case one conveyor element 16, which is fed to the next rail section 12 in the conveying direction F by means of the drive arrangement 22.

Figure 7:
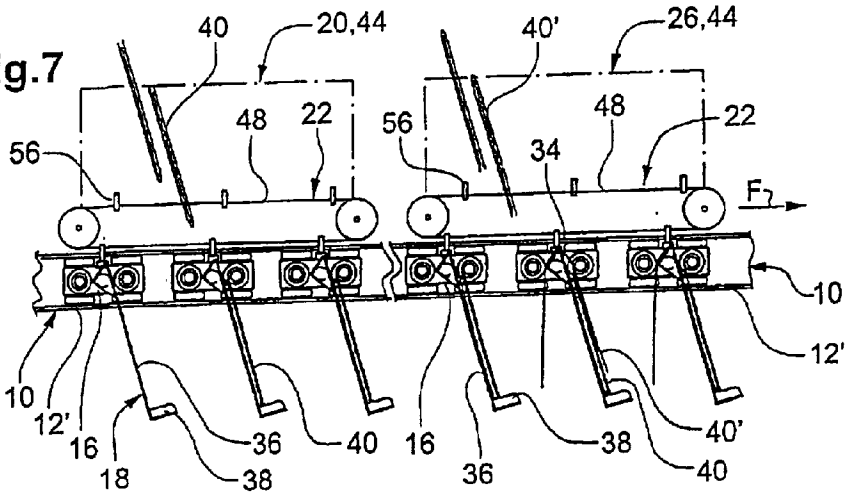
FIG. 7 shows two feed stations arranged one behind the other with associated drive arrangements which move the carrier elements at a specific spacing through the stations.

FIG. 7 shows a feed station 20 and a processing station 24 arranged at a distance and configured as a further feed station 26, these two stations each having an associated rail section 12' and an associated drive arrangement 22. Each of the two drive arrangements 22 has a belt 48 which is driven in circulation in the conveying direction F at a specific conveying speed and from which catching cams 56 project at a spacing one behind the other. These cams are intended for achieving form fitting engagement with the conveyor elements 16 in order to move them through the feed stations 20, 26 at the desired spacing and at the required conveying speed.

The feed station 20 is intended for feeding an object 40 from above to each of the carrier elements 18. In the example shown, the object is a folded printed product in which a further part product is arranged. The printed products are fed with the fold at the front so that their fold comes into contact with the base 38 and they can be transported further with their flat side lying on the rest element 36. The further feed station 26 is intended for opening, in a known manner, objects 40' configured as folded printed products and depositing them in straddling form onto the saddle-like rests 34 of the carrier elements 18 in such a way that they cover the objects 40 fed in the feed station 20.

Figure 8:
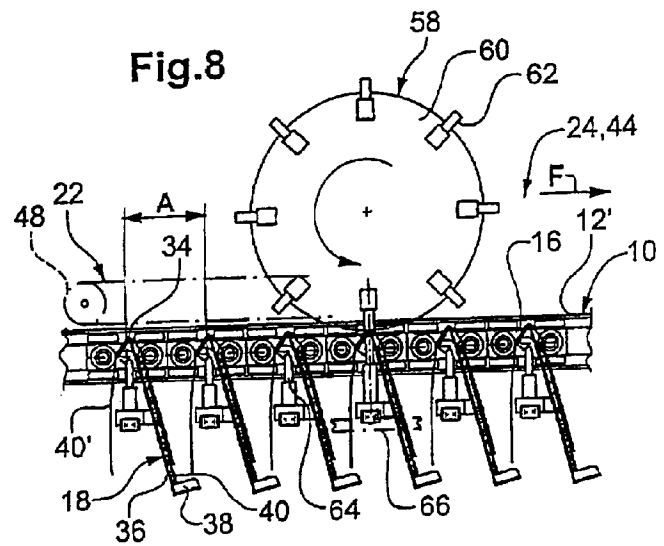
FIG. 8 shows a section of a device according to the invention with a rectilinear section of the rail system and a stapling apparatus.

FIG. 8 shows a rectilinear rail section 12' which is assigned to a processing station 24 having a stapling apparatus 58. The drive arrangement 22 of this processing station 24 is intended for moving the conveyor elements 16 resting on one another through the processing station 24 at the cycle rate of the stapling apparatus 58. The stapling apparatus 58 has stapling heads 62 arranged at equal spacings along the circumference of a carrying disk 60 driven in rotation. The spacing between the stapling heads 62 and the rotational speed of the carrying disk 60 are matched to the spacing B between successive carrier elements 18 in such a way that a stapling head 62 coincides with each carrier element 18 with the result that said stapling head can insert a staple into the objects 40' deposited in straddling fashion onto the rests 34. Each carrier element 18 is assigned a bending-over device 64 which is controlled, for example, by means of a slotted guide 66 in such a way that the staples inserted into the objects 40' are bent over in a known manner.

The mutual spacing of the carrier elements 18 is minimal in the station 44 with the stapling apparatus 58 and thus substantially smaller than in the feed stations 20, 26 shown in FIG. 7. With the same processing capacity, the conveying speed is thus slower in the case of the processing station 24 shown in FIG. 8 than in the feed stations 20, 26.

Figure 9:
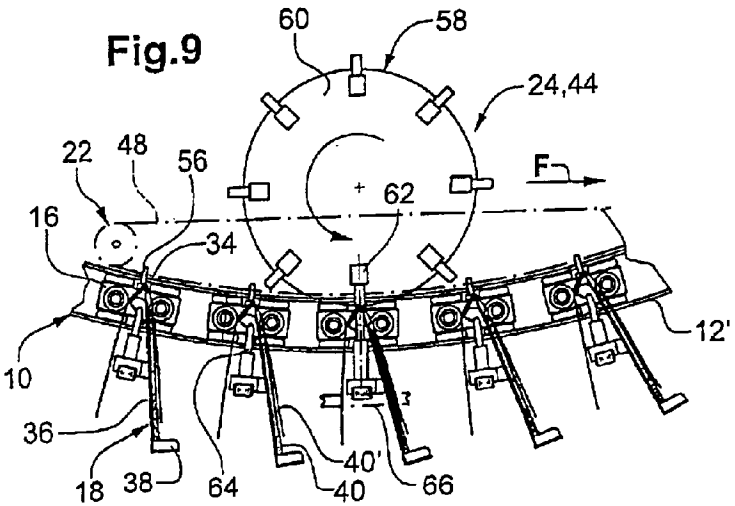
FIG. 9 shows part of a device according to the invention with a stapling apparatus arranged in curved section of the rail system.

FIG. 9 likewise shows a processing station 24 with a stapling apparatus 58 of the same construction as shown in FIG. 8 and described further above. The associated rail section 12', however, is convexly curved with respect to the stapling apparatus 58. This has the advantage that the change in angle between the stapling head 62 and the carrier element 18 takes place more slowly than in the case of the embodiment according to FIG. 8 with a rectilinear rail section. The drive arrangement 22 in turn has a belt 48 which is driven in the conveying direction F and has catching cams 56 for driving the conveyor elements 16 with a form-fitting connection. As said conveyor elements are moved through a curve, they are preferably held by means of the drive arrangement 22 at a spacing from one another which can be very small. A bending over device 64 with bending over means is also attached in this case to the rest element 36 of each carrier element 18, the bending over means being moved by means of a slotted guide control means so as to bend over staples.

The modules can be combined as desired to form a device because the stations 44 and the rail system 10 are constructed in modular fashion.

The carrier elements 18 can naturally also be of pocket shaped configuration and/or have opening and holding open elements or closing elements for the objects 40.

For the sake of completeness, it should be mentioned that the device always has a feed station 20 and an output station 28 and, between them, at least one processing station 24, it being possible for the latter also to be configured as a feed station 26. The processing station can, however, fulfill any other desired function.

In the embodiments shown, the rail system 10 has an intrinsically closed rail which comprises rail sections 12, 12', 12'', 12''' arranged one behind the other. A more complex rail system with diverters and the like is, however, also feasible, the diverters in turn preferably being configured in the manner of a processing station 24.

The carrier elements 18 do not necessarily have to have saddle-like rests 34 if objects 40' are not to be deposited in straddling fashion onto said rests. They can, however, also only have such rests 34 but no rest elements 36 or bases 38 if the objects 40' are only to be deposited in straddling fashion onto the rests 34 for processing.

In particular it is possible to keep the spacing of successive carrier elements small when collating objects and to select a larger spacing when collecting because spread products are to be deposited in straddling fashion onto the rests during collecting.

The device according to the invention is also suitable in particular for addressing objects, for gluing in cards, for example, or for inside printing, as the spacing between successive carrier elements can be selected in the stations 44 according to the requirements.

The device according to the invention allows the most diverse functions and processing operations to be performed on the same conveying path (i.e. rail system) without impairing smooth processing. The correspondingly required spacings can be set in the entire process sequence even in the case of mixed feeds, for example as shown in FIG. 7, and/or mixed processing.

That which is claimed:

1. An apparatus for processing flat products, comprising:

a rail system extending along a path of travel, a plurality of conveyor elements supported by the rail system for individual movement along the path of travel, a plurality of product carrier elements mounted to respective ones of the conveyor elements, with each of said carrier elements being configured for supporting thereon a flat product to be processed, a plurality of stations disposed serially along the path of travel, and including a product feed station wherein the products are delivered to the product carrier elements, a product processing station, and a product output station wherein the products are removed from the product carrier elements, and at least one of the stations including a dedicated drive arrangement for the conveyor elements for transporting the conveyor elements and thus the product carrier elements along the path of travel at a spacing and speed required by the associated station.

2. The apparatus as claimed in claim 1, wherein the rail system includes a buffer storage section connected upstream of each of the stations.

3. The apparatus as claimed in claim 1 wherein a section of the rail system is permanently joined to each of the stations.

4. The apparatus as claimed in claim 3, wherein the rail system has individual sections with some sections being permanently joined to a station and other sections serving as a buffer storage or connecting section, and it being possible to combine the sections as desired to form an intrinsically closed rail system.

5. The apparatus as claimed in claim 1, wherein said feed station has a dedicated drive arrangement which includes drivers driven in the conveying direction synchronously with the feed of the products, said drivers moving the conveyor elements through the feed station at a predetermined spacing.

6. The apparatus as claimed in claim 1, wherein the processing station has a supporting device which serves as an auxiliary drive and is configured for supporting the carrier elements at their free ends remote from the associated conveyor element.

7. The apparatus as claimed in claim 1, wherein the processing station has a stapling apparatus which is configured for introducing staples into folded products which have been deposited in straddling form onto saddle-like rests of the carrier elements.

8. The apparatus as claimed in claim 7, wherein the stapling apparatus has stapling heads which move along a closed circulating path, and the dedicated drive arrangement is configured for moving the conveyor elements according to the speed and the spacing of the stapling heads.

9. The apparatus as claimed in claim 8, wherein an associated section of the rail system is convexly curved with respect to the stapling apparatus.

10. The apparatus as claimed in claim 7, wherein each carrier element includes a saddle-like rest and a bending over device for bending over staples inserted into the products supported thereon.

11. The apparatus as claimed in claim 7, wherein at learnt two feed stations and a processing station are provided, with the processing station arranged downstream with respect to said feed stations and including a stapling apparatus, the spacings between the conveyor elements in the feed stations being greater than in the processing station having the stapling apparatus.

12. The apparatus as claimed in claim 1, wherein the carrier elements are arranged on the assigned conveyor elements on one side in the manner of a cantilever.

13. An apparatus for processing flat products, comprising:

a rail system extending along a closed path of travel, a plurality of conveyor elements supported by the rail system for individual movement along the path of travel, a plurality of product carrier elements mounted to respective ones of the conveyor elements, with each of said carrier elements being configured for supporting thereon a flat product to be processed, a plurality of stations disposed serially along the path of travel, and including a product feed station wherein the products are delivered to the product carrier elements, a product processing station, and a product output station wherein the products are removed front the product carrier elements, and each of the stations including a dedicated drive arrangement for the conveyor elements for transporting the conveyor elements and thus the product carrier elements along the path of travel at a spacing and speed required by the associated station.

14. The apparatus as claimed in claim 13 further comprising at least one conveyor drive positioned between two of the stations for delivering the conveyor elements to the downstream station.

15. The apparatus as claimed in claim 13 wherein each of the product carriers comprises a rest wall and a base, and a saddle-like rest extending along an upper edge of the rest wall.

* * * * *

UNITED STATES PATENT AND TRADEMARK OFFICE

CERTIFICATE OF CORRECTION

PATENT NO. : 6,764,069 B2
DATED : July 20, 2004
INVENTOR(S) : Reist

It is certified that error appears in the above-identified patent and that said Letters Patent is hereby corrected as shown below:

Column 8,
Line 16, “learnt” should read -- least --;
Line 40, “front” should read -- from --.

Signed and Sealed this

Fourteenth Day of December, 2004

JON W. DUDAS
*Director of the United States Patent and Trademark Office*